United States Patent [19]

Janney et al.

[11] Patent Number: 5,010,560

[45] Date of Patent: Apr. 23, 1991

[54] DATA LOGGING APPARATUS

[75] Inventors: Mark A. Janney, Temple; Roger Newey, Scottsdale; Irwin J. Robinson, III, Mesa, all of Ariz.

[73] Assignee: Marconi Instruments, Inc., Scottsdale, Ariz.

[21] Appl. No.: 297,690

[22] Filed: Jan. 17, 1989

[51] Int. Cl.[5] ..... G04F 10/00

[52] U.S. Cl. ..... 377/20; 364/569; 368/118

[58] Field of Search ..... 377/20; 364/569; 368/118

[56] References Cited

U.S. PATENT DOCUMENTS

| | | | |
|---|---|---|---|
| 4,166,360 | 9/1979 | Yamaguchi | 377/20 |
| 4,168,531 | 9/1979 | Eichelberger et al. | 364/900 |
| 4,195,220 | 3/1980 | Bristol et al. | 377/20 |
| 4,598,375 | 7/1986 | Hiramatsu et al. | 364/569 |
| 4,677,580 | 6/1987 | Suluski | 364/569 |
| 4,685,061 | 8/1987 | Whitaker | 377/20 |
| 4,712,072 | 12/1987 | Kawanabe | 377/20 |

*Primary Examiner*—John S. Heyman

*Attorney, Agent, or Firm*—Kirschstein, Ottinger, Israel & Schiffmiller

[57] ABSTRACT

In data logging applications an apparatus for real-time stamping data includes a reference time base, a short stopwatch circuit operative for generating a short-time stamp, and a long stopwatch circuit operative for generating at intervals a long-time stamp. Data to be logged with the short-time stamp is combined therewith and stored. A controller circuit controls the storage of the data and of the long-time and the short-time stamps. The controller circuit stores the long-time stamp at predetermined intervals.

5 Claims, 4 Drawing Sheets

| 9-BIT TIME | DATA | FULL-TIME |
|---|---|---|
| 123 | 000A | 0123 |
| 500 | 000B | 0500 |
| 488 | 000C | 1000 |
| 476 | 000D | 1500 |
| 464 | 000E | 2000 |

| MODULO - 9-BIT TIME | DATA | FULL-TIME | |
|---|---|---|---|
| 123 | 000A | 0123 | |
| 500 | 000B | 0500 | |
| 488 | 000C | 1000 | |
| 478 | 000D | 1500 | INTERVAL = 2548 |
| 476 | [0003] | 2012 | |
| 464 | 000E | 4048 | |
| 464 | [0008] | 4560 | |

[ ] INDICATE LONG TIME STAMPS

DATA LOGGING APPARATUS

BACKGROUND OF THE INVENTION

1. Field of the Invention

The present invention concerns data handling systems and in particular systems where items of data have to be tagged with real-time information.

2. Description of Related Art

Thus data logging applications sometimes require the inclusion of real-time information with each data sample. This is particularly so when data samples are received by the data logger at irregular time intervals e.g. in logic analysis systems. Real-time information can be appended to the data by simply increasing the width of the data store and storing the value of a stopwatch alongside the data. Stopwatch is a term used in the specification to denote a timing device which accumulates the time elapsed since the beginning of operation. This process is known as Time Stamping.

This is a simple form of time stamping but one which has notable disadvantages. In order for the timekeeper or stopwatch to possess a large dynamic range it must be many bits in width. It may perhaps be even wider than the data word. This consumes a considerable amount of the total store. Also, the stopwatch must be able to count time at the maximum data logging rate. This rate could be considerable and may therefore preclude the use of relatively simple but slow, ripple type counters. It may also preclude the use of slower less expensive technologies.

OBJECTS OF THE INVENTION

One object of the present invention is to provide apparatus for adding real-time information to data samples which reduces the total amount of memory required to store the time-stamped data samples.

Another object is to reduce the required operating frequency of the time stamp counters. A still further object of the invention is to permit the use of slower, less expensive and lower power consumption time stamp counters.

BRIEF DESCRIPTION OF THE DRAWINGS

In order that the invention may be more readily understood an embodiment thereof will now be described with reference to the accompanying drawings, in which.

DETAILED DESCRIPTION OF THE PREFERRED EMBODIMENTS

Figures 1, 2, 3:
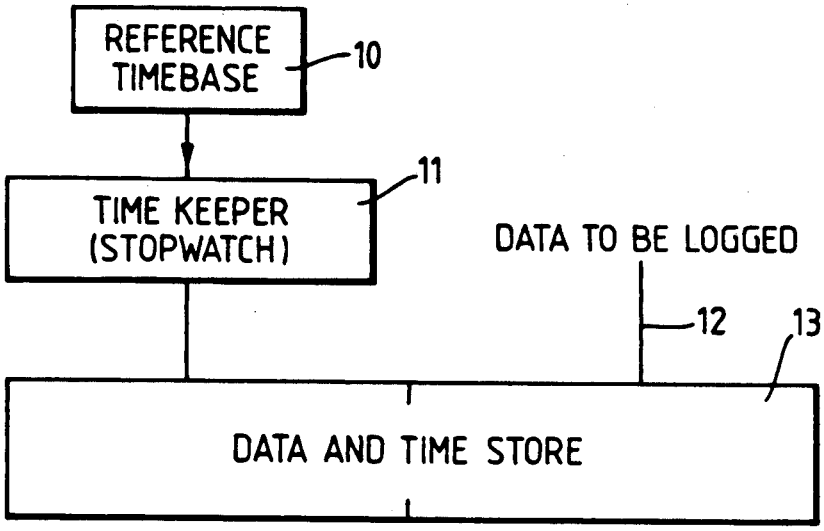
Fig. 1. PRIOR ART
FIG. 1 is a functional block diagram of a known data time stamping circuit according to the prior art.
FIG. 2 is a table illustrating a short time stamp.
FIG. 3 is a table illustrating a long time stamp.

Referring now to the accompanying drawings, FIG. 1 shows a known apparatus for time stamping data samples. Thus a reference timebase 10 provides a clock signal to a time-keeper or stopwatch circuit 11. Data samples to be logged and stored are transmitted on lines 12 and the apparatus is arranged such that when a data sample is to be stored the time as established by the time keeper circuit is appended to the data sample and the two items of data are stored alongside one another in a store 13.

The disadvantages of this time-stamping procedure have already been set out. In order to avoid these disadvantages the present invention proposes that the full time should not be stored with each data sample. Instead the time stamping apparatus stores only a small number "n" of the least significant bits of the stopwatch. Hereinafter this will be referred to as the "short time stamp". The use of the short time stamp enables the width of the store required for the time stamp to be reduced significantly. So long as data is stored more frequently than the full duration of the counter which acts as the time keeper (2 to the power of n) then no time information will be lost. In the example shown in the table of FIG. 2 the value of "n" is 9.

In this example the full duration of the counter is 2 to the power of 9 which equals 512. Each of the data samples is known to be no more than 512 time units distant from the previous data sample. If a short time-stamp is less than or equal to the previous short time stamp, then the short counter overflowed, rolling-over from 511 back to 0. In this case 512 must be added to compensate for the roll over. Consider the following examples:

Time of data 000B = Example 1

$$\text{Time of Data 000A} + \frac{|500 - 123|}{\text{No roll over}} = 500$$

Time of data 000C = Example 2

$$\text{Time of Data 000B} + 488 - \frac{|500 + 512|}{\text{Roll-over}} = 1000$$

This method is sufficient if data is stored at intervals less than or equal to 512 time units. However if data storage is less frequent, then significant bits of time information will be lost. The loss of time information can be avoided by storing the full value of the stopwatch before the time interval between samples is allowed to exceed 512. This is known as the 'full time-stamp' and is demonstrated in FIG. 3. When the interval between samples becomes equal to 512, a sample containing only time information (no data) is stored. The short time-stamp is stored in the normal manner, and the space which is normally reserved for data is used to store the remainder of the stopwatch (the more significant bits) or the 'long time-stamp'. The short time stamp and the long time stamp taken together constitute the full time stamp.

In FIG. 3, the digits within the square brackets are in fact long time-stamps rather than data. In order to distinguish long time stamps from data it is necessary to add one more bit to the width of the store. This bit can then be used as a flag to indicate whether this item is data or long time-stamp.

The full time for any data sample can now be computed by working backwards from the first full time-stamp—to follow. Consider the following examples from FIG. 3.

Full time-stamp following data 000D = Example 3

-continued $$(3 \times 512) + 476 = 2012$$

Time of data 000D =

$$(\text{Full time-stamp}) - \frac{|476 + 476 - 512|}{\text{Roll-over}} = 1500$$

Time of data 000C = Example 4

$$(\text{Time of data 000D}) - \frac{|476 + 488 - 512|}{\text{Roll-over}} = 1000$$

Notice also that once a full time-stamp has been stored, it is not necessary to store more full time-stamps even if the interval to the next data sample is many times 512.

The time value in the long stopwatch changes infrequently (every 512 time intervals. When the short stopwatch rolls over from 511 back to 0). It is accordingly desirable to implement it using relatively slow and inexpensive components. For this reason the time stamper never attempts to store a full time-stamp during one of these changes.

It is not necessary to store the full time stamp when the interval exactly equals 512 as shown in FIG. 3. It is sufficient to store the full time-stamp at *any* time before then. This gives some flexibility in the decision as to when to store a full time-stamp. This flexibility is used to avoid storing a full time-stamp in proximity to the time when the long time-stamp increments.

Figure 4:
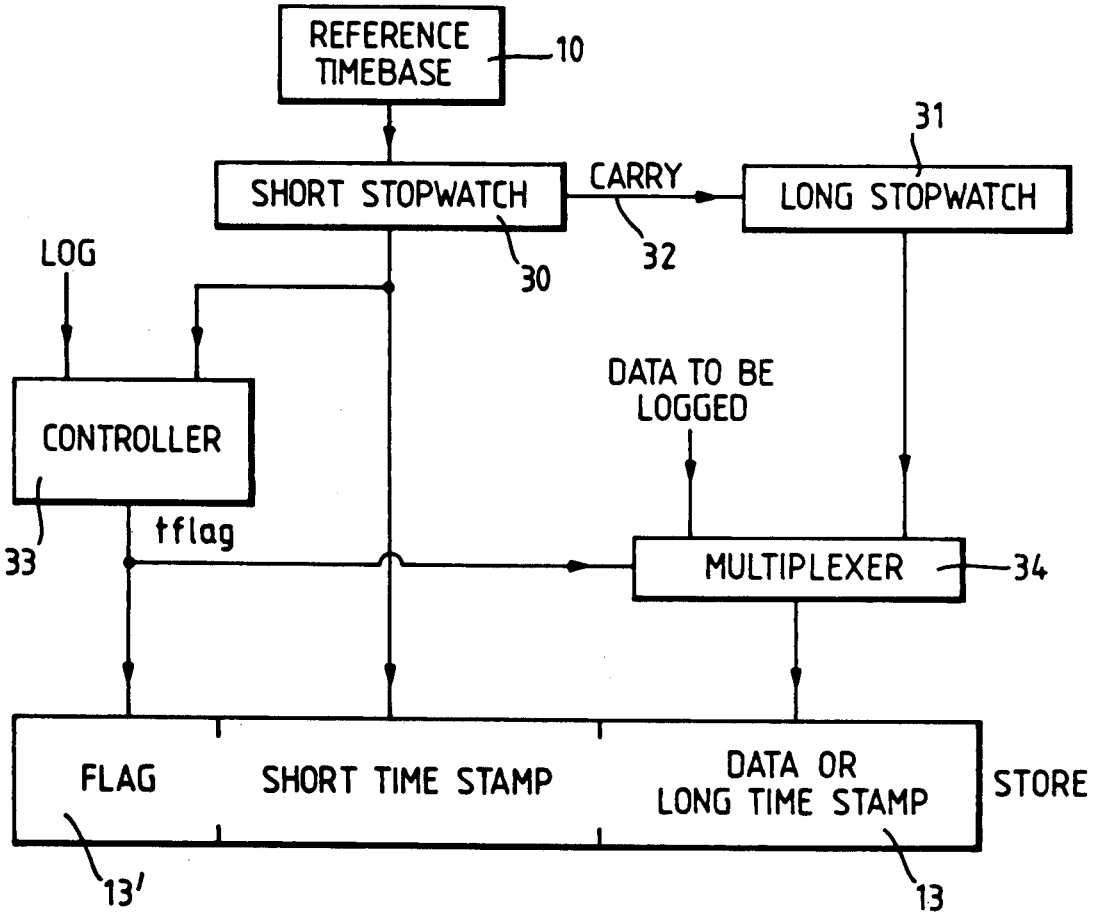
FIG. 4 is a functional block diagram of a data time stamping circuit according to the present invention.

Referring now to FIG. 4 of the accompanying drawings the data logging apparatus shown in this figure shares certain features in common with the known arrangement shown in FIG. 1. Features which are common to the two embodiments have been given the same reference numerals. However in the FIG. 4 embodiment the output of the reference tire base 10 is firstly taken to a short stopwatch circuit 30 which is in turn connected to a long stopwatch circuit 31 by a carry line 32.

The short stopwatch circuit gives shortened time signals of the kind shown in the first column of FIG. 2 to a controller circuit 33. The controller 33 is responsible for deciding when to store the long time stamp which is output by the long stopwatch circuit 31.

The input "log" to the controller circuit 33 signifies that data is present for logging—the controller circuit 33 monitors the "log" input and the short stopwatch 30 and determines the optimum times at which to store long time stamps from the long stopwatch 31.

When a long stopwatch is to be stored in the store 13 the controller 33 switches a multiplexer 34 to pass the long stopwatch to the store 13.

The controller circuit 33 simultaneously generates a flag which is stored at 13' in store 13 to indicate that it is not data which is being stored in store 13 but a long time stamp. When the long time stamp has been stored the controller circuit 33 switches the multiplexer 34 to pass data to the store 13 and also removes the flag.

Figure 5:
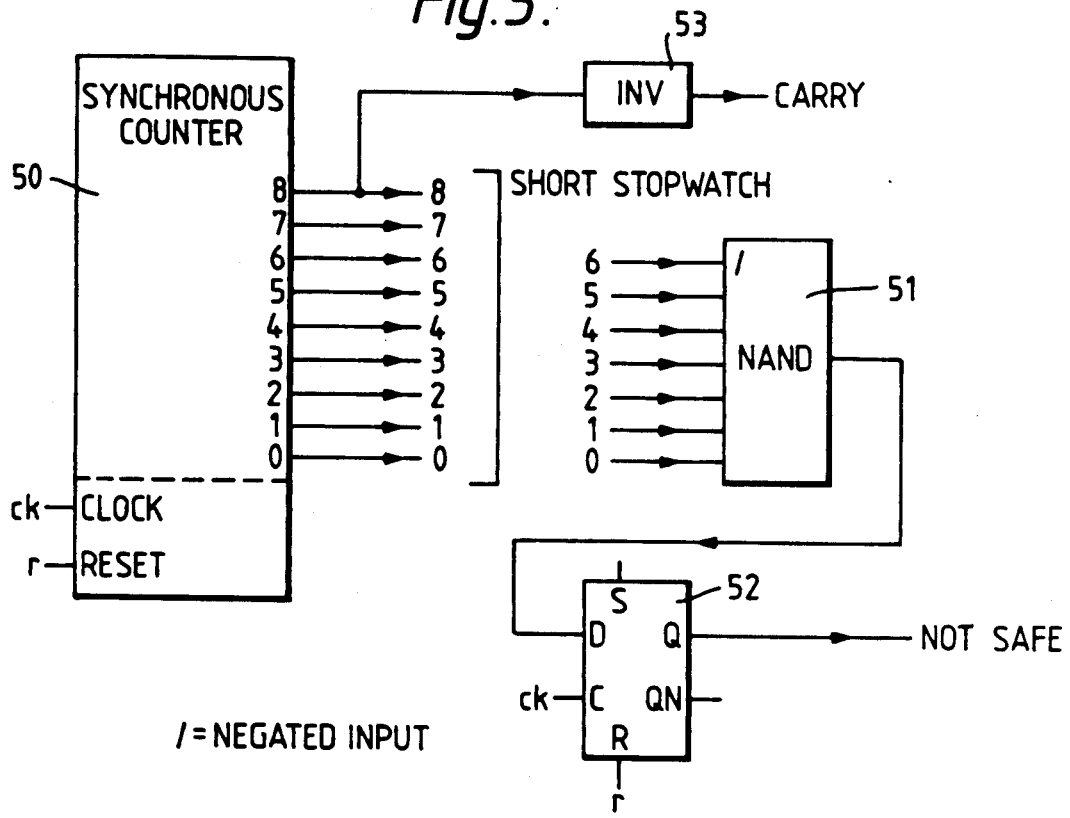
FIG. 5 is a block diagram of part of the circuit of FIG.4.
Figure 6:
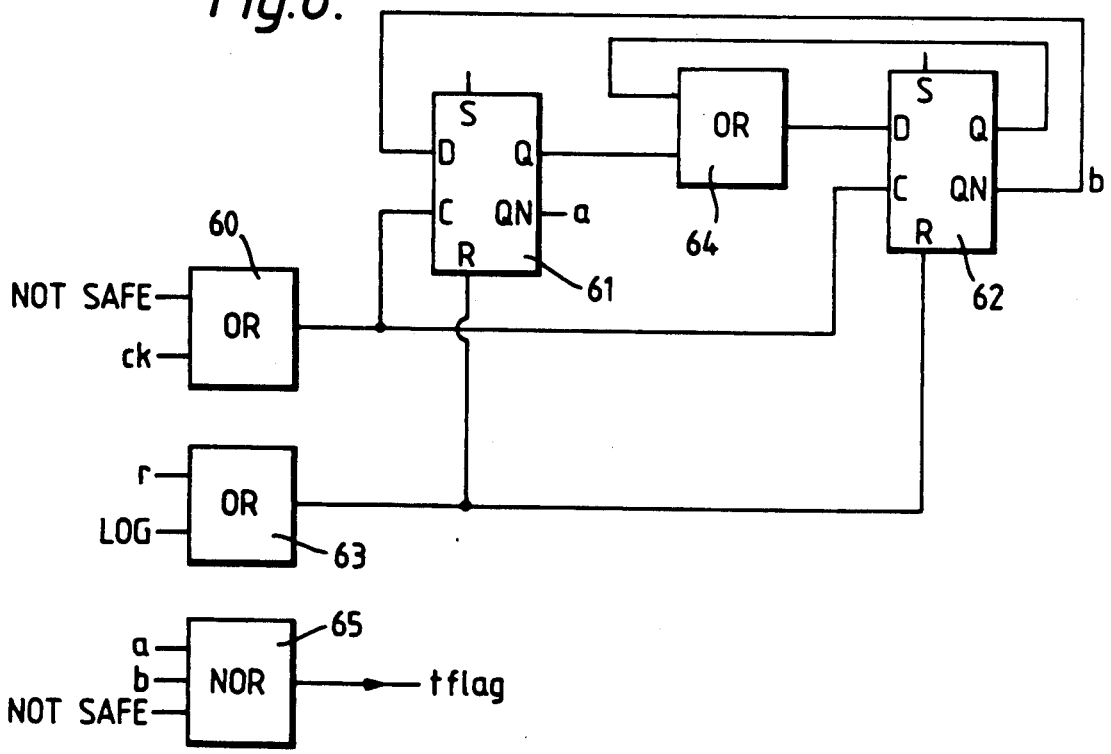
FIG. 6 is a block diagram of another part of the circuit of FIG. 4.

The controller is comprised of the circuits which appear in FIGS. 5 and 6. The circuit shown in FIG. 5 comprises a synchronous counter 50 having outputs 0–8 providing the short stopwatch. A signal CK is the master clock input and acts as the reference time base. Signal r is a reset signal which is pulsed 1 at the counter beginning of our operation and clears the stopwatch counter to 0. A Nand-gate 51 is connected to the outputs 0–6 of counter 50 so as to produce a 0 output at the four count values 63, 191, 319 and 447. The output of Nand-gate 51 is connected to a flip-flop 52 so that the signal "not safe" results in Ø at the four points 64, 192, 320 and 448. These are the "safe store" points. Otherwise the output of flip-flop 52 is 1.

The most significant bit (output 8) of the counter 50 is taken to an inverter 53 to provide the "carry" signal. This occurs when the counter 50 rolls over from 511 to 0 and as shown in FIG. 4 the carry signal is supplied to the long stopwatch.

FIG. 6 shows a "safe counter " circuit which counts the occurrence of "safe store points". This circuit comprises an OR-gate 60 to which the not safe signal and the clock signal CK are both applied, the output of gate 60 being taken to the C inputs of a pair of linked flip-flops 61, 62.

The reset signal r and the log signal are applied to the inputs of an OR-gate 63 the output of which is taken to the R-inputs of flip-flops 61, 62. The Q output of flip-flop 61 is connected to one input of an OR-gate 64 the other input of which is the Q output of flip-flop 62, the output of OR-gate 64 being taken to the D input of flip-flop 62. The QN output of flip-flop 62 is taken to the D input of flip-flop 61 and provides a signal b whilst the QN output of flip-flop 61 provides a signal a. These two signals are taken to a NOR-gate 65 along with the not-safe signal and the output of gate 65 is the signal tflag.

The "safe-counter" circuit of FIG. 6 operates to count the occurrences of "safe-store points". On the third occurrence of a "safe-store-point" it generates the tflag signal which switches the multiplexer and causes a long time stamp to be stored in store.

Figure 7:
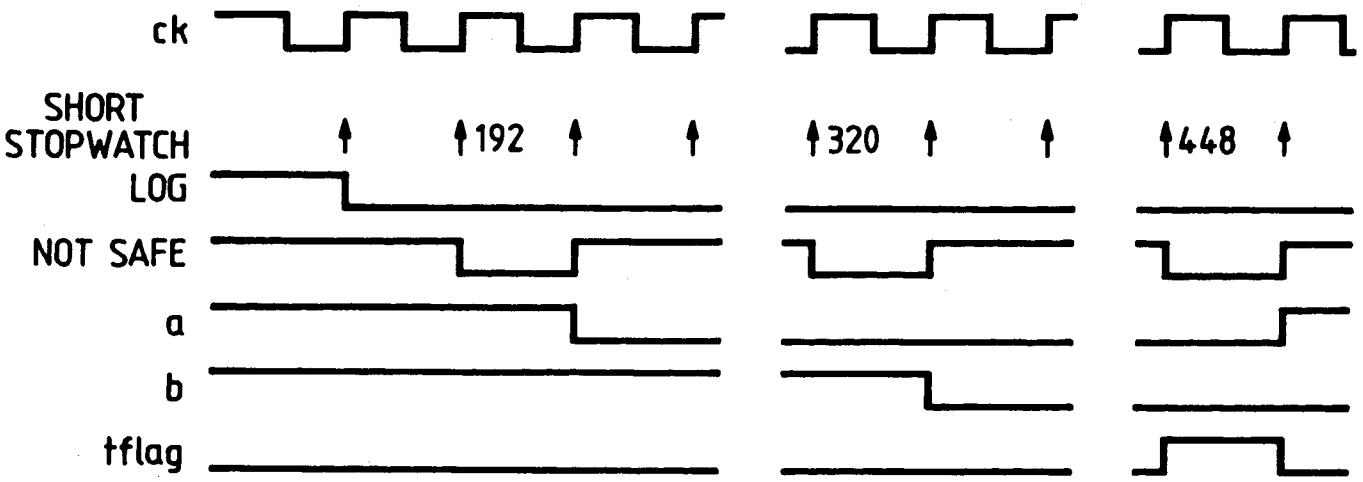
FIG. 7 is a timing diagram of the operation of the circuit of FIG. 5.
Figure 8:
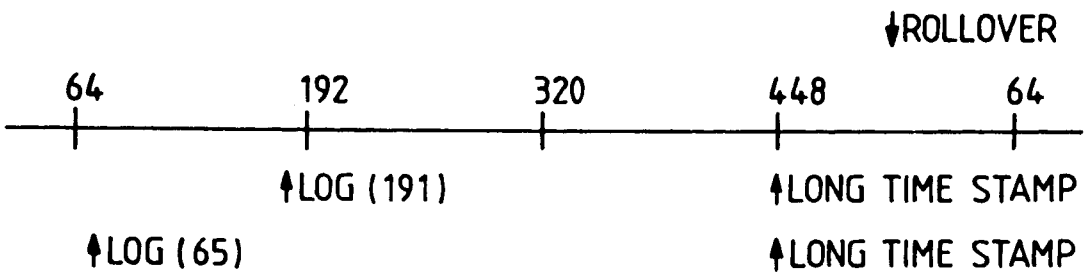
FIG. 8 is a diagram illustrating intervals at which the long time stamping occurs.

This operation is illustrated in the timing diagram of FIG. 7. When the control signal "log" is 1 this indicates that a data sample is to be stored. Any occurrence of "log" equal to 1 will reset the safe-counter. Thus for a long time stamp to be stored there must occur three "safe-store-points" in succession whilst 'log'=0. This represents an interval between 257 and 383, as can be seen in FIG. 8. This is less than 512 and so meets the objectives which have already been set out.

We claim:

1. Apparatus for real-time stamping data in data logging applications, the apparatus comprising:

a) a reference time base;

b) short stopwatch means for generating from the reference time base a short-time stamp;

c) means for combining data to be logged with said short-time stamp;

d) means for storing the data and the short-time stamp;

e) a long stopwatch means connected to said short stopwatch means for generating at intervals a long-time stamp; and f) a controller circuit for controlling the storage of the data and of the long-time and short-time stamps, the controller circuit being operative to store said long-time stamp at predetermined intervals.

2. Apparatus as claimed in claim 1, and further comprising a multiplexer to which said data and said long-time stamp are supplied, the controller circuit causing the long-time stamp to be stored in the place of data.

3. Apparatus for real-time stamping data in data logging applications and comprising:

a) synchronous counter for counting to a predetermined value in response to a reference time base;

b) short stopwatch circuit means responsive to a selected number of the least significant output bits of said synchronous counter to generate a short stopwatch time;

c) long stopwatch circuit means connected to said short stopwatch circuit means by a carry line to generate a long stopwatch time;

d) control means for detecting when the interval between data to be stored is greater than the capacity of said counter; and e) means for storing the long stopwatch time in response to said control means.

4. Apparatus as claimed in claim 3, including means for generating a flag when said long stopwatch time is stored.

5. Apparatus as claimed in claim 3, wherein said control means includes safe counter means for ensuring that said long stopwatch time is not stored during changeover of said counter.

* * * * *